United States Patent [19]

Fadiga et al.

[11] 3,942,778

[45] Mar. 9, 1976

[54] AUTOMATIC CONTOUR-CONFORMING SUPPORT PALLET

[75] Inventors: Dario J. Fadiga; Reynaldo C. T. Soderman, both of Buena Park, Calif.

[73] Assignee: Quality Research Engineering Corporation, Buena Park, Calif.

[22] Filed: Feb. 14, 1975

[21] Appl. No.: 549,960

[52] U.S. Cl. ..... 269/26; 269/266; 324/73 PC

[51] Int. Cl.[2] ..... B25B 1/24

[58] Field of Search..... 269/26, 266, 267; 324/73 PC; 339/17 L, 176 MP, 75 MP

[56] References Cited

UNITED STATES PATENTS

| | | | |
|---|---|---|---|
| 2,338,603 | 1/1944 | Schultz | 269/266 |
| 2,399,824 | 5/1946 | Pressman | 269/266 |
| 2,882,771 | 4/1959 | Blazek | 269/266 |
| 2,918,648 | 12/1959 | Ludman et al. | 324/73 PC |
| 3,824,462 | 7/1974 | Vinsani | 324/73 PC |
| 3,830,956 | 8/1974 | Wootton et al. | 324/73 PC |
| 3,868,102 | 2/1975 | Pevar | 269/266 |

*Primary Examiner*—Al Lawrence Smith
*Assistant Examiner*—Robert C. Watson
*Attorney, Agent, or Firm*—Philip M. Hinderstein

[57] ABSTRACT

A pallet for providing total and positive support for an object which is being subjected to a force capable of distorting or destroying it if unsupported, the support pallet automatically conforming to the contour of the object. The pallet comprises a plurality of elongate pistons; means for supporting the pistons in parallel, spaced-apart relationship for independent axial movement relative to the support means; and means for applying an equal force to each piston to urge all of the pistons in the same direction, into contact with the object.

6 Claims, 4 Drawing Figures

FIG. 1.
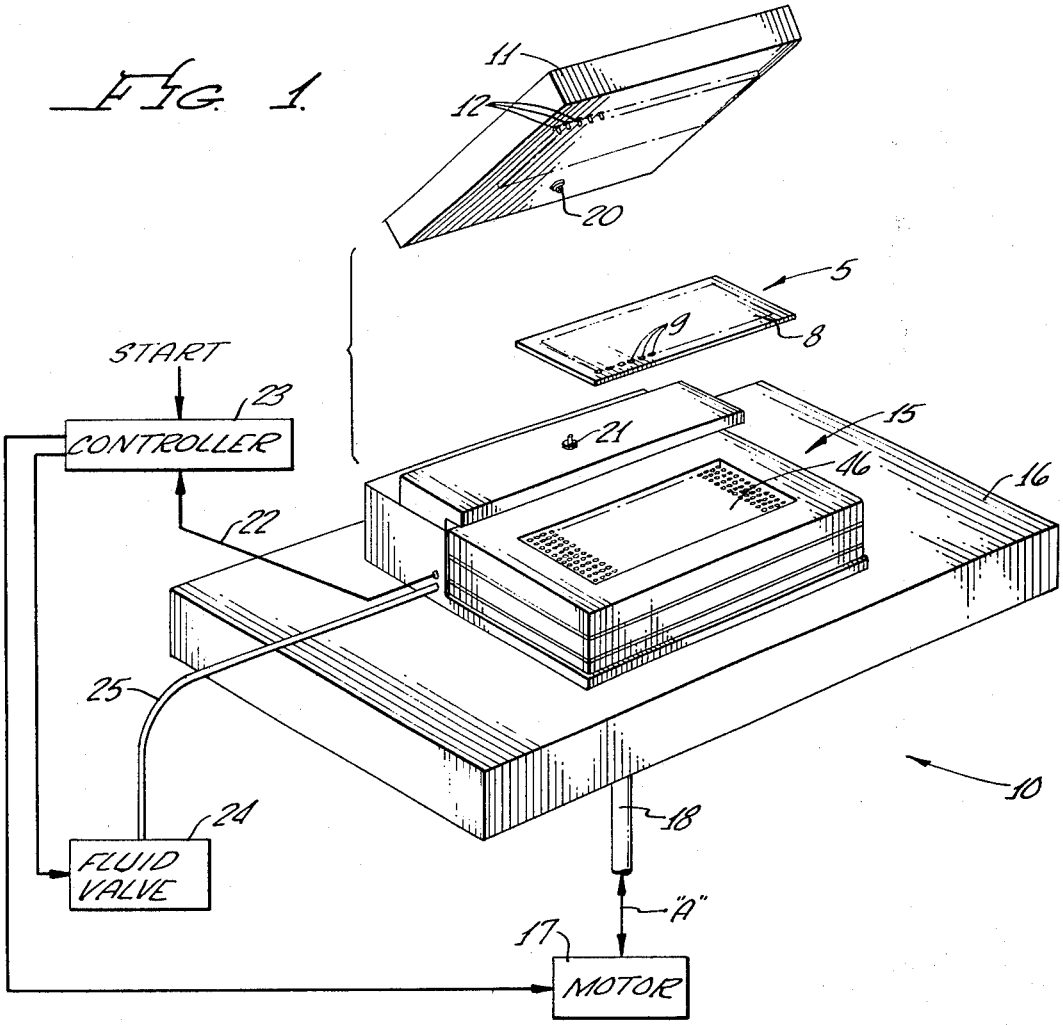
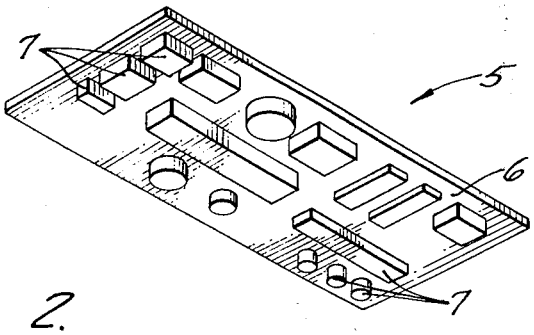
FIG. 2.

FIG. 3.
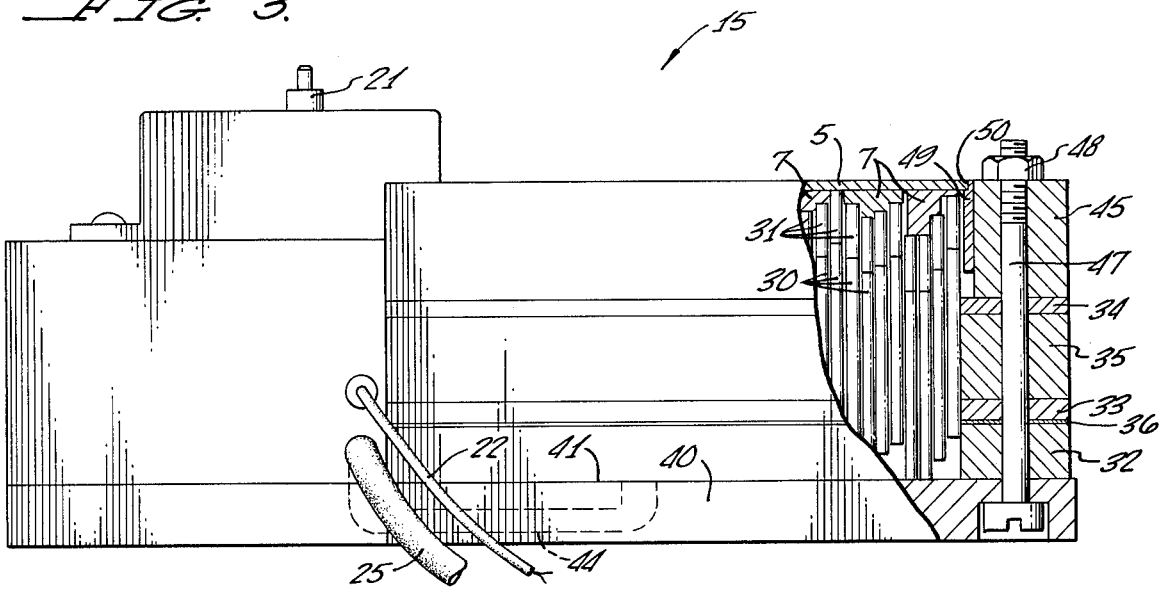
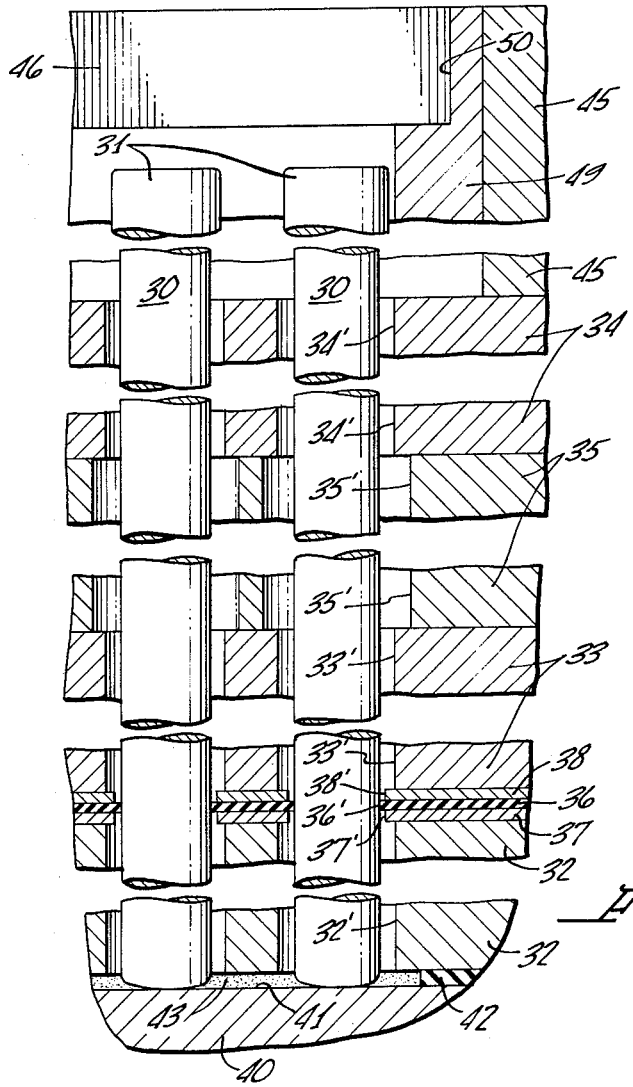
FIG. 4.

AUTOMATIC CONTOUR-CONFORMING SUPPORT PALLET

BACKGROUND OF THE INVENTION

1. Field of the Invention

The present invention relates to an automatic contour-conforming support pallet and, more particularly, to a holding pallet for providing total and positive support for an object which is being subjected to a force capable of distorting or destroying it if unsupported.

2. Description of the Prior Art

There are numerous circumstances where an object is subjected to a force capable of distorting or destroying it if unsupported. While providing such support presents no particular problem when the object has a flat or regular surface, providing suitable support is often a serious problem where the supported surface of the object is irregular and/or is subject to change.

A typical example of the latter situation is found in the testing of electronic assemblies, such as printed circuit boards having discrete components mounted on one side thereof and a plurality of electrical contact points on the other side thereof. A widely accepted and proven method for testing such electronic assemblies is to connect them to an automatic circuit analyzer which is capable of performing several thousand tests per minute. Various ways are used to connect the assembly to the circuit analyzer. One circuit analyzer includes a plurality of spring-loaded probes supported in parallel, spaced-apart relationship and connected to the analyzer circuitry. The probes are brought into contact with the contact points of the circuit board, thus establishing a conductive path between the analyzer circuitry and the components mounted on the circuit board.

Such probes, by virtue of being spring loaded, exert a force on the circuit board during the testing procedure. While the force exerted by each probe is only on the order of a few ounces, it is multiplied by the number of probes, resulting in a total force of many pounds over the surface area of the circuit board. If the board is supported only around the edges thereof, the center of the board will be deflected relative to such edges. This can crack the discrete components mounted on the board and/or the conductive strips on the board, and can damage or crack the connecting adhesive between the multiple layers of a multi-layer board. Thus, under such circumstances, it is absolutely essential to support the entire surface of the board.

One common approach to the solution of this problem is simply to support the component side of the circuit board on a flat surface, which surface contacts only some of the circuit components. As a result, less than all of the components support all of the weight of the testing force. While such a procedure has often been acceptable in the past, when using rugged components having the capability of withstanding the total applied force, such a procedure is often unacceptable with new, more sensitive components, such as crystals and the like, which cannot tolerate such forces.

One common technique for distributing the force over substantially the entire surface of the board is to use a support surface which has been molded or formed to conform to the contour of the supported surface of the object under test. While such technique is obviously effective for many identical products, it is not necessarily effective for all identical products since normal manufacturing tolerances simply prevent all products from being identical and such molded supports cannot adjust themselves for variations among the same product. Furthermore, a different support must be made for every different product and this is time-consuming and costly.

SUMMARY OF THE INVENTION

According to the present invention, these problems are solved by providing a holding pallet which provides total and positive support for an object, such as a printed circuit board having discrete components mounted on one side thereof. The present support pallet automatically conforms to the contour of the object and, therefore, distributes the supporting force equally over the entire supported surface of the object. The present support pallet is ideally suited for circuit boards having sensitive components thereon and to products which vary in contour as a result of normal manufacturing procedures. Furthermore, the present support pallet can be used for an indefinite number of different products since the support surface automatically conforms itself to the supported surface of the object.

Briefly, the present automatic contour-conforming pallet for supporting an object comprises a plurality of elongate pistons; a plurality of support plates each having a plurality of parallel, spaced-apart holes therein, one hole for each of the pistons, the respective holes in all of the support plates being aligned, the support plates supporting the pistons in parallel, spaced-apart relationship for independent axial movement relative thereto, the diameter of each of the holes in the support plates being slightly greater than the diameter of each of the pistons; a thin, flexible, sealing member positioned between two of the support plates, the sealing member having a plurality of parallel, spaced-apart holes therein aligned with the holes in the support plates, the diameter of each of the holes in the sealing member being slightly less than the diameter of each of the pistons to form a fluid-tight seal between the sealing member and the pistons; means defining a chamber on one side of the sealing member, first ends of the pistons being movable in the chamber; and means for conducting fluid pressure into the chamber, the fluid pressure applying an equal force to the first ends of each of the pistons to urge all of the pistons in the same direction, into contact with the object, to support same.

OBJECTS

It is therefore an object of the present invention to provide an automatic contour-conforming support pallet.

It is a further object of the present invention to provide a holding pallet for providing total and positive support for an object which is being subjected to a force capable of distorting or destroying it if unsupported.

It is a still further object of the present invention to provide an automatic contour-conforming support pallet which distributes the entire supporting force over substantially the entire surface of an object being supported.

It is another object of the present invention to provide an automatic contour-conforming support pallet which automatically adjusts itself for variations in the contour of an object being supported.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

BRIEF DESCRIPTION OF THE DRAWINGS

FIG. 1 is a diagramatic view of a system for supporting and testing a circuit board constructed in accordance with the teachings of the present invention;

FIG. 2 is a further diagramatic view of a portion of FIG. 1;

FIG. 3 is a partial sectional view of the automatic contour-conforming support pallet of the system of FIG. 1 taken along the line 3—3 in FIG. 1; and FIG. 4 is an enlarged view of a portion of the sectional view of FIG. 3.

DESCRIPTION OF THE PREFERRED EMBODIMENT

Referring now to the drawings and, more particularly, to FIGS. 1 and 2 thereof, there is shown diagramatically a system, generally designated 10, for supporting one side of an object which is being subjected to a force on an opposite side thereof. System 10 will be described in its preferred embodiment, i.e. for supporting one side 6 of a circuit board 5, side 6 having a plurality of discrete components 7 mounted thereon, while the other side 8 of circuit board 5, which has a plurality of electrical contact points 9 thereon, is subjected to a testing operation by a test head 11. However, it will be apparent to those skilled in the art that system 10 and the components thereof have wide applicability for supporting any number of different objects for any number of different purposes.

A widely accepted and proven method for testing a circuit board, such as board 5, is to connect it to an automatic circuit analyzer (not shown) by means of test head 11. Test head 11 includes a plurality of spring-loaded probes 12 supported in parallel, spaced-apart relationship with the same orientation and spacing as the pattern of contact points 9 on side 8 of circuit board 5. By bringing probes 12 into contact with contact points 9 of circuit board 5, a conductive path may be established between the analyzer circuitry and components 7 mounted on board 5.

System 10 includes an automatic contour-conforming pallet, generally designated 15, which is mounted on a movable platen 16. Platen 16 is mounted for movement toward and away from head 11, in the direction indicated by arrow "A", under the control of a suitable motor 17 connected thereto by a shaft 18. Thus, pallet 15 is supported for movement relative to test head 11, circuit board 5 being adapted to be positioned with side 6 thereof resting on pallet 15 and with side 8 thereof facing probes 12 of test head 11.

For reasons which will appear more fully hereinafter, test head 11 has mounted thereon a first sensor 20 and pallet 15 has mounted thereon a second sensor 21, sensors 20 and 21 being positioned so as to contact each other when probes 12 touch contact points 9 on circuit board 5. When sensors 20 and 21 make contact, an electrical signal is applied via a line 22 to a system controller 23. System controller 23 provides activating signals for motor 17 and a fluid valve 24, the latter conducting a fluid, such as air, via a conduit 25 to pallet 15, as will be explained more fully hereinafter.

Referring now to FIGS. 3 and 4, the general principle of support pallet 15 is to provide a reaction to any force, applied or gravitational, which is being exerted on an object being supported. Such a reactive force is applied to the object regardless of its shape because pallet 15 automatically conforms itself to any and all shapes. More specifically, pallet 15 comprises a plurality of elongate pistons 30 which are supported in parallel, spaced-apart relationship for independent axial movement. Pistons 30 can be made out of steel, with or without an insulating cap 31, may be entirely made out of plastic, or may be made of any material which would lend itself to the duty cycle to which they are to be subjected. The length of each piston 30 and the distance of its travel, the diameter of pistons 30 and the spacing therebetween can be varied depending upon the application.

Pistons 30 are supported by means of first, second, and third generally rectangular, planar support plates 32–34, respectively, positioned in parallel, spaced relationship. Support plates 32–34 have pluralities of parallel, spaced-apart holes 32', 33', and 34', respectively, therein, one hole in each support plate for each piston 30, the respective holes 32'–34' in support plates 32–34, respectively, being aligned. Furthermore, the diameters of all of holes 32'–34' are equal and are slightly greater than the diameters of pistons 30. According to one embodiment of pallet 15, where the diameter of each piston 30 is 0.092 inch, the diameter of each hole 32'–34' in support plates 32–34, respectively, is 0.096 inch. Therefore, in view of the small difference in size between pistons 30 and holes 32'–34' in support plates 32–34, respectively, holes 32'–34' perform a guiding function, aligning pistons 30 and preventing lateral movement or tipping thereof.

Support plates 32 and 33 are positioned closely adjacent each other, near the lower ends of pistons 30, whereas support plate 34 is spaced from plates 32 and 33, adjacent the upper ends of pistons 30. The desired spacing between plates 33 and 34 is provided by a spacer plate 35 which has a plurality of parallel, spaced-apart holes 35' therein, one hole for each of pistons 30, holes 35' in spacer plate 35 being aligned with respective holes 32'–34' in support plates 32–34, respectively. The main difference between spacer plate 35 and support plates 32–34 is that the diameter of the holes in spacer plate 35 is substantially greater than the diameter of pistons 30, i.e. 0.106 inch, so that spacer plate 35 performs purely a spacing function and not a guiding function.

Pallet 35 includes a thin, flexible, sealing member 36 positioned between two relatively thin supports 37 and 38, the entire assembly being positioned between support plates 32 and 33. Whereas support plates 32–34, spacer plate 35, and supports 37 and 38 are made from suitable rigid materials such as aluminum, plastic, or the like, sealing member 36 is made of an elastomer, such as neoprene or any other material suitable for providing a seal between the piston chamber, to be described more fully hereinafter, and the atmosphere.

Sealing member 36 and supports 37 and 38 have pluralities of parallel, spaced-apart holes 36'–38', respectively, therein, holes 36'–38' being aligned with respective holes 32'–35' in support plates 32–34 and spacer plate 35, respectively. The diameter of each of holes 36' is slightly less than the diameter of pistons 30 to provide the necessary fluid-tight seal between sealing member 36 and pistons 30. By way of example, and using the dimensions given previously, the diameter of each hole 36' in sealing member 36 is 0.089 inch. On the other hand, the diameter of holes 37' and 38' in supports 37 and 38, respectively, is greater than the diameter of pistons 30 but less than the diameter of holes 32'–34', i.e. 0.093 inch. Thus, the function of supports 37 and 38 is to prevent movement of sealing member 36 as pistons 30 move, which would effect the sealing action of sealing member 36.

Plates 32–35, sealing member 36, and supports 37 and 38 are mounted on a generally rectangular base plate 40 which may be made out of aluminum or any other suitable material. In order to achieve a complete seal between base plate 40 and the other components, the upper surface 41 of base plate 40 must be substantially planar and free of blemishes which could create an air path and air leaks, for reasons which will appear more fully hereinafter.

An annular gasket 42 is positioned between surface 41 of base plate 40 and piston plate 32, around the outside of holes 32' in support plate 32 and pistons 30, gasket 42 serving several purposes. In the first instance, gasket 42 separates and provides a space 43 between surface 41 of base plate 40 and the lower surface of support plate 32, space 43 defining a chamber between plates 32 and 40. Furthermore, gasket 42 provides a seal around the perimeter of chamber 43, sealing member 36 sealing the upper end of chamber 43.

Pallet 15 also includes a passageway 44 through base plate 40, one end of passageway 44 terminating within chamber 43 annd the other end of passageway 44 terminating outside of chamber 43. As shown in FIG. 3, base plate 40 may be larger than the remaining plates 32–35 to provide an area for access to the outer end of passageway 44. Conduit 25 from fluid valve 24 is connected to the outer end of passageway 44 thereby permitting the conduction of fluid pressure from valve 24 to chamber 43, as will be explained more fully hereinafter.

Pallet 15 further includes an annular top plate 45 which defines the sides of an open-ended chamber 46 in which piston heads 31 move, the base of chamber 46 being defined by support plate 34. Plate 45 may be mounted on and supported relative to base plate 40 along with support plates 32–34, spacer plate 35, sealing member 36, and supports 37 and 38. A plurality of elongate bolts 47 and mating nuts 48 may be used to interconnect plates 32–35 and 40, sealing member 36, and supports 37 and 38, as shown. Positioned within chamber 46 and connected to the internal perimeter of top plate 45 are a plurality of thin, elongate strips 49, each having a groove 50 along the upper inner edge thereof for receipt of a corresponding edge of circuit board 5, as will appear more fully hereinafter.

In order to insure alignment of all holes 32'–38', support plates 32–34 and supports 37 and 38 are preferably drilled simultaneously to insure that the holes in all five parts are properly aligned. Simultaneously with this operation, holes 35' in spacer plate 35 are being drilled on an adjacent, interconnected fixture to obtain proper alignment of its holes with those in plates 32–34 and supports 37 and 38. After this operation, supports 37 and 38 may be removed and holes 32'–34' in plates 32–34, respectively, redrilled by themselves to a diameter 0.003 inch larger.

Holes 36' in sealing member 36 are preferably fabricated by a punching operation performed simultaneously with the drilling of holes 32'–34', 37' and 38' in support plates 32–34 and supports 37 and 38, respectively. This is done in this manner to achieve proper alignment between all such holes.

Pistons 30 are made of a corrosion resistant material to avoid corrosion due to the moisture which can be carried by the air. The surface finish of pistons 30 must be very smooth to be able to provide a seal with sealing member 36 and to have a very low break-loose force. Piston caps 31 are preferably provided at the exposed ends of pistons 30. Caps 31 are made of an insulating material for those applications in which pistons 30 come into contact with an item which is being subjected to an electrical test. Otherwise, caps 31 may not be necessary.

OPERATION

In operation, circuit board 5 is positioned in chamber 46, at the top of support pallet 15, with at least some of the edges thereof resting in grooves 50 in support strips 49. Previous adjustments, not a part of the present invention, have aligned pallet 15 relative to test head 11 so that probes 12 are aligned with contact points 9 on side 8 of circuit board 5.

With system 10 so positioned and the test ready to proceed, controller 23 is manually started to signal motor 17 to drive platen 16 upwardly, moving pallet 15 and circuit board 5 towards test head 11. At this time, fluid valve 24 is closed and no fluid pressure is conducted to chamber 43. Sensors 20 and 21 on test head 11 and pallet 15, respectively, are positioned so that a signal is generated on line 22 as soon as probes 12 touch contact points 9 on side 8 of circuit board 5. Controller 23 interprets this signal and activates fluid valve 24 to conduct a predetermined amount of fluid pressure to chamber 43, via conduit 25 and passageway 44 in base plate 40.

The amount of force applied by valve 24 to chamber 43 is equal to the total force applied by probes 12 to circuit board 5. That is, by multiplying the force of the spring bias on each probe 12 by the number of probes, the total force exerted on side 8 of circuit board 5 can be determined. If an approximately equal force is applied to chamber 43, such force is automatically equally distributed among pistons 30 thereby urging all of pistons 30 in the same direction, upwardly, until piston caps 31 contact side 6 of circuit board 5 or one of components 7. In other words, since each of pistons 30 is supported independently for axial movement through holes 32'–34' in support plates 32–34, respectively, and since chamber 43 is sealed by sealing member 36 and gasket 42, the total pressure in chamber 43 will be exerted on the ends of pistons 30, urging them outwardly. Furthermore, since the diameters of all pistons 30 are equal, this force will be divided equally among all of pistons 30.

According to system 10, it is desired to move circuit board 5 toward test head 11 beyond the point of initial contact to insure a slight compression of the springs biasing probes 12 and a firm contact between probes 12 and contact points 9. Accordingly, upon receipt of a signal over line 22, controller 23 signals motor 17 to elevate platen 16 and pallet 15 by a predetermined additional amount, such as an additional ⅛ inch. Since the compression of the springs biasing probes 12 will increase the force applied by probes 12 to contact points 9 of circuit board 5, controller 23 simultaneously signals valve 24 to apply an increased pressure to chamber 43 to balance this increased force. According to one embodiment of the present invention, this additional movement of platen 16 approximately doubles the force applied by each probe 12 to each contact point 9 so that controller 23 signals valve 24 to double the pressure applied to chamber 43.

It can therefore be seen that according to the present invention, the previously described problems of the prior art are solved by providing a holding pallet 15 which provides total and positive support for an object, such as a printed circuit board 5 having discrete components 7 mounted on side 6 thereof. Pistons 30 provide numerous support points for circuit board 5 and the upper ends of pistons 30, in chamber 46, automatically conform to the contour of circuit board 5, therefore distributing the supporting force equally over the entire supported surface of an object. Pallet 15 is ideally suited for circuit boards having sensitive components mounted thereon and to products which vary in contour as a result of normal manufacturing procedures. Furthermore, support pallet 15 can be used for an indefinite number of different products since the support surface defined by the upper ends of piston 30 automatically conforms itself to the contour of the supported surface of the object.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

We claim:

1. An automatic contour-conforming pallet for supporting an object comprising:

a plurality of elongate pistons;

first and second support plates, each having a plurality of parallel, spaced-apart holes therein, one hole for each of said pistons, the respective holes in said support plates being aligned, said support plates supporting said pistons in parallel, spaced-apart relationship for independent axial movement relative thereto, the diameter of each of said holes in said support plates being slightly greater than the diameter of each of said pistons;

a sealing member positioned between said first and second support plates, said sealing member consisting of a thin sheet of flexible sealing material having a plurality of parallel, spaced-apart holes therein, aligned with said holes in said first and second support plates, the diameter of each of said holes in said sealing member being slightly less than the diameter of each of said pistons to form a fluid-tight seal between said sealing member and said pistons;

means defining a chamber on one side of said sealing member, first ends of said piston being movable in said chamber; and means for conducting fluid under pressure into said chamber, said fluid applying an equal force to said first ends of each of said pistons to urge all of said pistons in the same direction, into contact with said object, and to hold each of said pistons in contact with said object with the same force.

2. An automatic contour-conforming support pallet according to claim 1 further comprising:

a third support plate having a plurality of parallel, spaced-apart holes therein, one hole for each of said pistons, the diameter of each of said holes in said third support plate being approximately equal to the diameter of each of said holes in said first and second support plates; and means for supporting said third support plate in parallel, spaced-apart relationship to said first and second support plates, the holes in said third support plate being aligned with respective holes in said first and second support plates, said first and second support plates supporting first ends of said pistons and said third support plate supporting the other ends of said pistons.

3. An automatic contour-conforming support pallet according to claim 1 wherein said chamber defining means comprises:

a base plate having a substantially planar first surface, one side of said first support plate being positioned on said first surface of said base plate, said sealing member and said second support plate being positioned adjacent the other side of said first support plate; and an annular gasket positioned between said first surface of said base plate and said one side of said first support plate, around the outside of said holes therein, said annular gasket separating and providing a space between said first surface of said base plate and said one side of said first support plate, said space being said chamber.

4. An automatic contour-conforming support pallet according to claim 3 wherein said means for conducting fluid under pressure into said chamber comprises:

means defining a passageway through said base plate, one end of said passageway terminating within said chamber, the other end of said passageway terminating outside of said chamber, said other end of said passageway being adapted for connection to a source of fluid under pressure.

5. A system for supporting one side of an object which is being subjected to a force on an opposite side thereof from a testing device or other pressure applying means comprising:

a plurality of elongate pistons;

means for supporting said pistons in parallel, spaced-apart relationship for independent axial movement relative to said support means, said object being positionable with said one side thereof adjacent first ends of said pistons with said opposite side thereof adjacent said pressure applying means, said supporting means being movable toward said pressure applying means;

means associated with second ends of said pistons for applying an equal force to each of said pistons to urge all of said pistons in the same direction, relative to said supporting means, until said first ends thereof contact said one side of said object, the total force applied to said pistons by said force applying means being approximately equal to the force applied to said opposite side of said object by said pressure applying means;

means for sensing contact between said opposite side of said object and said pressure applying means; and means responsive to said contact sensing means for activating said force applying means when contact is made between said pressure applying means and said object.

6. An object supporting system according to claim 5 wherein said activating means is further responsive to contact between said pressure applying means and said object for simultaneously providing a signal to move said supporting means a predetermined additional distance toward said pressure applying means and signaling said force applying means to apply an increased force to each of said pistons so as to equal the increased force applied to said opposite side of said object by said pressure applying means.

* * * * *